United States Patent [19]

Clapp et al.

[11] Patent Number: 4,799,554

[45] Date of Patent: Jan. 24, 1989

[54] PRESSURE ACTUATED CLEANING TOOL

[75] Inventors: Timothy D. Clapp, Kenai, Ak.; William H. McCormick, Plano, Tex.

[73] Assignee: Otis Engineering Corporation, Dallas, Tex.

[21] Appl. No.: 131,847

[22] Filed: Dec. 11, 1987

Related U.S. Application Data

[63] Continuation-in-part of Ser. No. 37,176, Apr. 10, 1987, abandoned.

[51] Int. Cl.[4] ..... E21B 37/00

[52] U.S. Cl. ..... 166/312; 166/223; 175/424; 134/167 C

[58] Field of Search ..... 166/312, 222, 223, 304, 166/311, 902; 175/424; 134/167 C, 168 C, 22.12

[56] References Cited

U.S. PATENT DOCUMENTS

| | | | |
|---|---|---|---|
| 3,285,485 | 11/1966 | Slator | 226/172 |
| 3,313,346 | 4/1967 | Cross | 166/0.5 |
| 3,559,905 | 2/1971 | Palynchuk | 242/54 |
| 3,720,264 | 3/1973 | Hutchison | 166/311 |
| 3,811,499 | 5/1974 | Hutchison | 166/67 |
| 3,829,134 | 8/1974 | Hutchison | 285/14 |
| 3,850,241 | 11/1974 | Hutchinson | 166/222 |
| 3,958,641 | 5/1976 | Dill et al. | 166/312 |
| 4,088,191 | 5/1978 | Hutchison | 166/223 |
| 4,216,910 | 8/1980 | Kimbrough | 134/167 C |
| 4,349,073 | 9/1982 | Zublin | 166/312 |
| 4,441,557 | 4/1984 | Zublin | 166/312 |
| 4,442,899 | 4/1984 | Zublin | 166/312 |
| 4,518,041 | 5/1985 | Zublin | 166/312 |
| 4,625,799 | 12/1986 | McCormick et al. | 166/223 |
| 4,694,908 | 9/1987 | Morris et al. | 166/902 |
| 4,700,776 | 10/1987 | Petrovic | 166/157 |

FOREIGN PATENT DOCUMENTS

| | | | |
|---|---|---|---|
| 0371983 | 5/1973 | U.S.S.R. | 134/167 C |

*Primary Examiner*—George A. Suchfield
*Assistant Examiner*—Terry Lee Melius
*Attorney, Agent, or Firm*—Thomas R. Felger

[57] ABSTRACT

Apparatus for pressurized cleaning of flow conductors. The apparatus has a first mandrel and a second mandrel telescoped therein. A cleaning tool can be attached to the second mandrel. Changes in fluid pressure flowing through the mandrels will cause the second mandrel to rotate relative to the first mandrel. Rotation is used to direct fluid jets in the cleaning tool towards different portions of the interior of the flow conductor. Rotation of the cleaning tool can also be used for hydraulic drilling of deposits within the flow conductor.

14 Claims, 5 Drawing Sheets

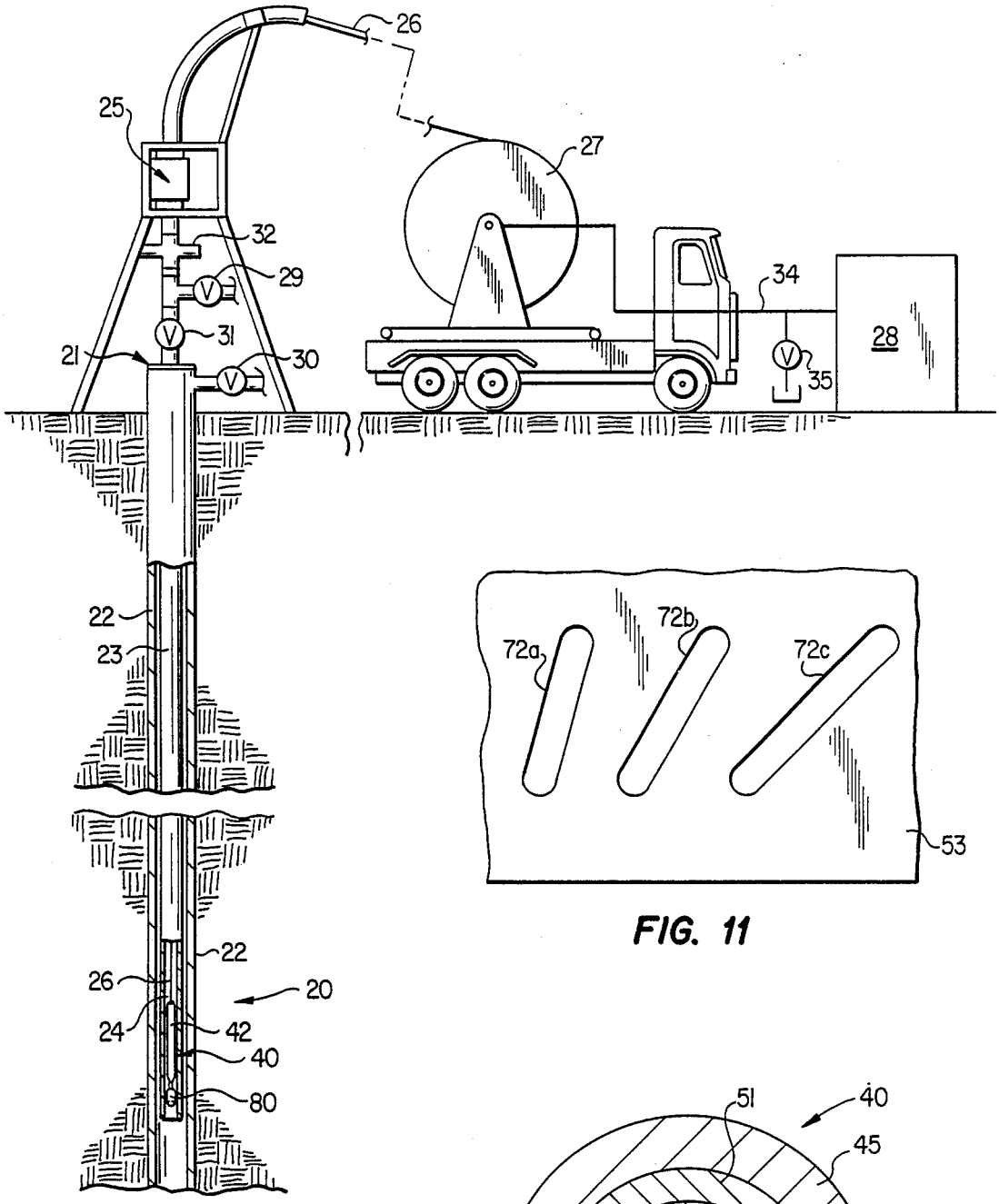
FIG. 1
FIG. 11
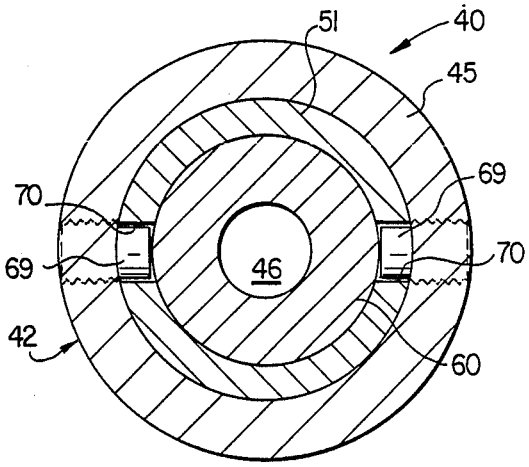
FIG. 10

PRESSURE ACTUATED CLEANING TOOL

This is a continuation in part of pending U.S. patent application Ser. No. 07/037,176 filed Apr. 10, 1987 now abandoned.

BACKGROUND OF THE INVENTION

1. Field of the Invention

This invention relates to the servicing of wells by use of coil tubing and more particularly to removal of scale and other downhole deposits from the inside diameter of well tubulars.

2. Description of Related Art

It has been common practice for many years to run a continuous reeled pipe (known extensively in the industry as "coil tubing") into a well to perform operations utilizing the circulation of treating and cleanout fluids such as water, oil, acid, corrosion inhibitors, hot oil, etc. Coil tubing, being continuous rather than jointed, is run into and out of a well with continuous movement of the tubing through use of a coil tubing injector.

Coil tubing is frequently used to circulate cleanout fluids through a well for the purpose of eliminating sand bridges, scale, and similar downhole obstructions. Often such obstructions are very difficult and occasionally impossible to remove because of the inability to rotate the coil tubing to drill out such obstructions. Turbo-type drills have been used but develop insufficient torque for many jobs. Various devices have been used to attempt removal of foreign material from the interior of the well tubing. This well tubing varies from unperforated and perforated tubulars to slotted or wire-wrapped well liners. Such well tubing often becomes plugged or coated with corrosion products, sediments and hydrocarbon deposits.

Wire brushes, scrapers, scratchers and cutters of various designs were among the first tools used to try to remove unwanted deposits. Some of these tools did not reach into the slots or perforations. Those with wires or feelers thin enough to enter the slot or perforation were often too thin to provide much cleaning force. Several types of washing tools are available which use pressurized jets of fluid in an attempt to dislodge undesired material from the well tubing. The development of jet cleaning has advanced from low velocity for use in cleaning and acidizing to abrasive particles suspended in high pressure fluids. Abrasives are used for cleaning flow conductors, but with results less than favorable since the flow conductors are sometimes eroded along with the foreign material plugging or coating the flow conductors.

U.S. Pat. No. 4,625,799 discloses a mechanically indexed cleaning tool. The apparatus of this patent led to the development of the present invention.

U S. Pat. No. 3,285,485 which issued to Damon T. Slator on Nov. 15, 1966 discloses a device for handling tubing and the like. This device is capable of injecting reeled tubing into a well through suitable seal means, such as a blowout preventer or stripper, and is currently commonly known as a coil tubing injector.

U.S. Pat. No. 3,313,346 issued Apr. 11, 1967 to Robert V. Cross and discloses methods and apparatus for working in a well using coil tubing.

U.S. Pat. No. 3,559,905 which issued to Alexander Palynchuk on Feb. 2, 1971 discloses an improved coil tubing injector.

High pressure fluid jet systems have been used for many years to clean the inside diameter of well tubulars. Examples of such systems are disclosed in the following U.S. Pat. Nos.:

| | | |
|---|---|---|
| 3,720,264 | 3,850,241 | 4,441,557 |
| 3,811,499 | 4,088,191 | 4,442,899 |
| 3,829,134 | 4,349,073 | 4,518,041 |

Outside the oil and gas industry, tubing cleaners have been used for many years to remove scale and other deposits from the inside diameter of tubes used in heat exchangers, steam boilers, condensers, etc. Such deposits may consist of silicates, sulphates, sulphides, carbonates, calcium, and organic growth. Co-pending patent application Ser. No. 06/861,417 filed May 9, 1986, now U.S. Pat. No. 4,705,107, discloses the use of such equipment to clean well tubulars downhole.

U.S. Pat. Nos. 4,583,592 issued Apr. 22, 1986 and 4,420,044 issued Dec. 13, 1983 show examples of a continuous J-slot or control slot used to manipulate components in a downhole well tool.

The preceding patents are incorporated by reference for all purposes within this application.

SUMMARY OF THE INVENTION

The present invention is directed towards improved methods and apparatus for cleaning well tubulars or flow conductors using coil tubing.

The present invention is an apparatus for cleaning flow conductors including but not limited to downhole tubing, casing, and flow lines. The apparatus may be attached to a flexible or rigid conduit such as coil tubing or small diameter pipe which is connected to a source of cleaning fluid. The cleaning fluid is pumped under pressure to the apparatus with a cleaning tool attached. Coil tubing with the apparatus attached is run into a flow conductor to the area to be cleaned.

The apparatus has an outer mandrel and an inner mandrel which is selectively rotated relative to the outer mandrel in part by control slots in response to fluid pressure changes. Longitudinal movement of the inner mandrel relative to the outer mandrel is translated by the control slots and two sets of ratchet teeth into indexed rotation of the inner mandrel. Indexed rotation of the inner mandrel positions a cleaning tool attached thereto to clean different portions of the flow conductor.

The present invention eliminates the need to twist or rotate the coil tubing to ensure uniform cleaning of the inside diameter of the well flow conductor. The present invention is particularly useful when well conditions downhole limit the ability of longitudinal movement to rotate the cleaning tool.

One object of this invention is to provide a cleaning tool which indexingly rotates in response to cleaning fluid pressure changes thereby allowing fluid nozzles in the cleaning tool to direct cleaning fluid at different segments of the flow conductor.

Another object of this invention is to provide a cleaning tool which can be operated without twisting or rotating the tubing supplying the cleaning fluid to the cleaning tool.

A further object is to provide apparatus that allows quick replacement of the cleaning tool for use in different sizes of flow conductors without having to replace the complete apparatus.

Another object is to provide apparatus with the cleaning tool modified for hydraulic or jet drilling of sand bridges blocking the flow conductor.

The present invention allows selection of the amount of rotation that will result from each pressure change. Different control slot angles can be used to cause the inner mandrel to step or rotate through one, two or three ratchet teeth.

Additional objects and advantages of the present invention will be readily apparent to those skilled in the art after studying the written description in conjunction with the drawings and claims.

BRIEF DESCRIPTION OF THE DRAWINGS

FIG. 1 is a schematic drawing, partially in elevation and partially in section with portions broken away, showing a coil tubing unit and cleaning tool removing deposits from the inside diameter of a well tubular.

FIG. 10 is a drawing in section taken along line 10—10 of FIG. 2A.

FIG. 11 is a development drawing showing the cylinder and control slots which translate longitudinal movement into rotation.

DETAILED DESCRIPTION OF THE PREFERRED EMBODIMENTS

Figure 2A:
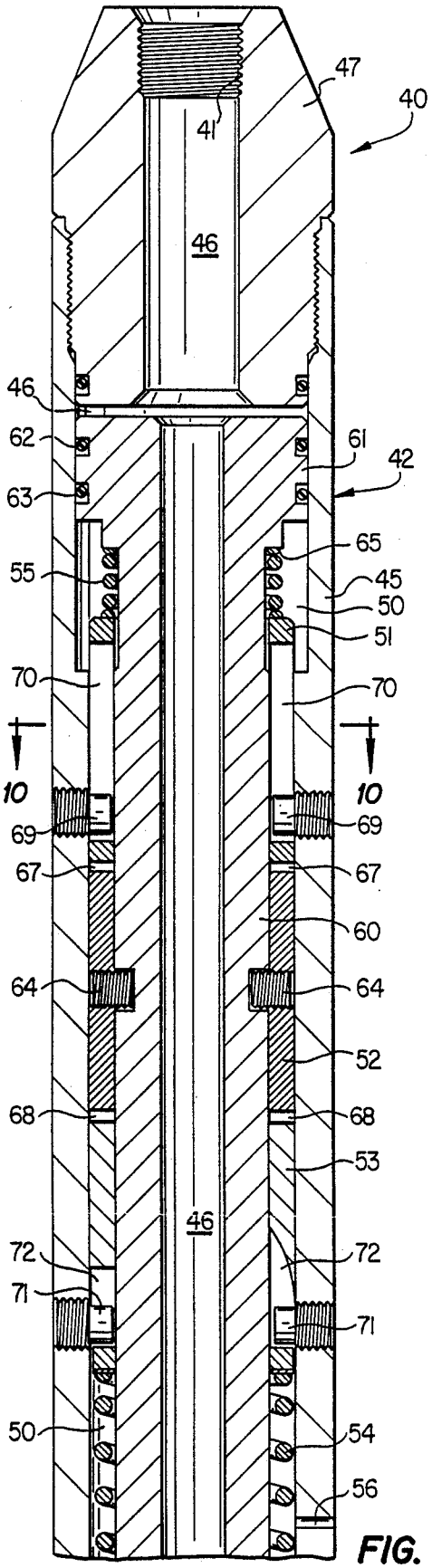
FIGS. 2A and B are enlarged drawings, partially in section and partially in elevation with portions broken away, showing an indexing tool of the present invention with alternative cleaning tools attached thereto.
Figure 2B:
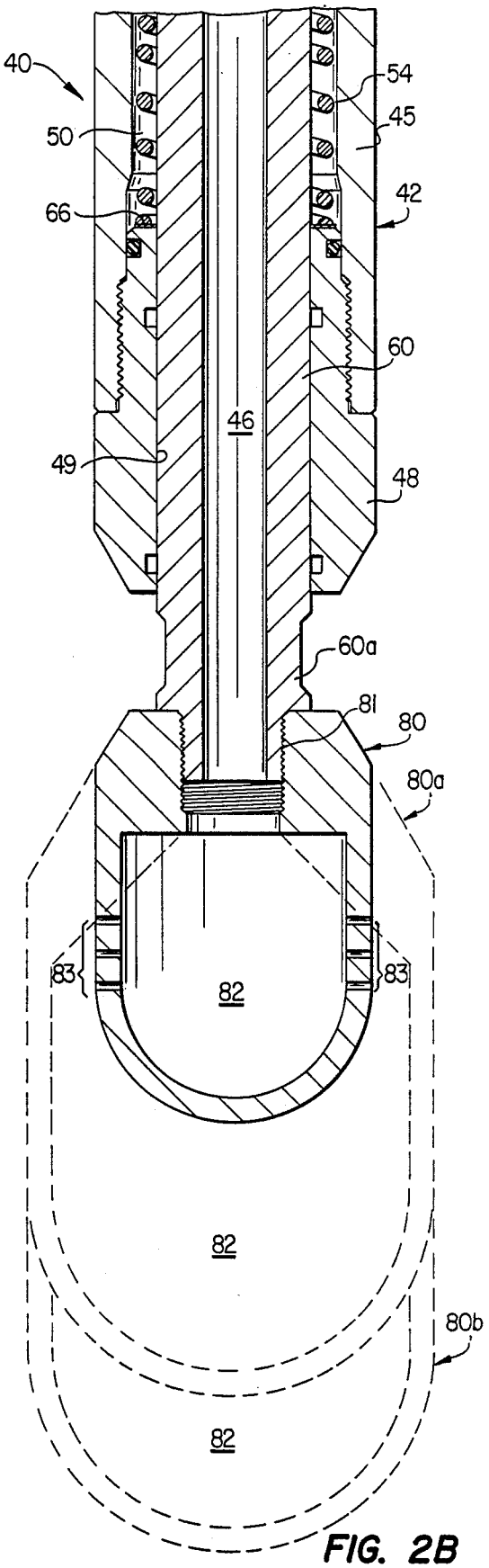
Figure 7:
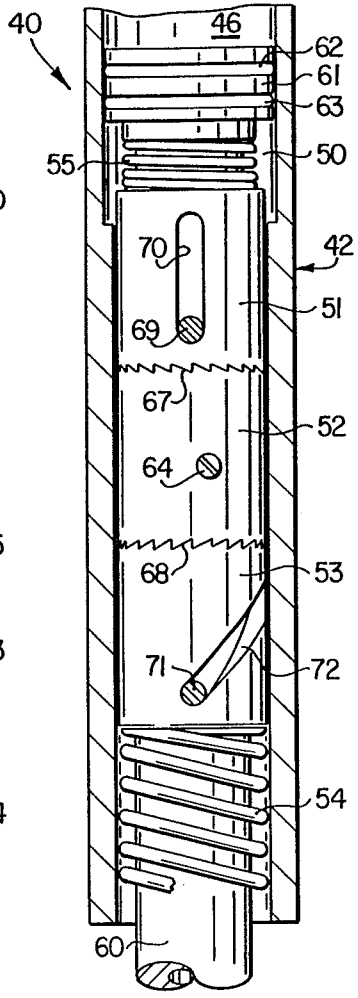
FIGS. 3–7 are schematic drawings, partially in section and partially in elevation, of the sequential steps as the indexing tool responds to fluid pressure changes to rotate its inner mandrel means relative to its outer mandrel means.

In FIG. 1 well 20 extends from wellhead 21 to an underground hydrocarbon or fluid producing formation (not shown). Well 20 is defined in part by casing string or well flow conductor 22 with tubing string 23 disposed therein. The present invention can be used with other types of well tubulars or flow conductors including liners and dual production tubing strings. Also, the present invention is not limited to use in oil and gas wells.

During the production of formation fluids, various types of deposits may accumulate on the inside diameter of flow conductors 22 and 23. Examples of soft deposits are clay, paraffin, and sand. Examples of hard deposits 114 are silicates, sulphates, sulphides, carbonates and calcium. The present invention is particularly useful for removal of hard deposits found in some geothermal and oil wells but may be satisfactorily used to remove other types of deposits such as sand bridges.

Using conventional well servicing techniques, injector 25 can be mounted on wellhead 21. Continuous or coil tubing 26 from reel 27 is inserted by injector 25 into bore 24 of tubing 23. Well cleaning apparatus 40 is attached to the lower end of coil tubing 26 by a suitable threaded connection 41. Manifold 28 includes the necessary pumps, valves, and fluid reservoirs to discharge high pressure cleaning fluid into bore 24 via coil tubing 26. Valves 29 and 30 can be used to control the return of spent cleaning fluid to the well surface. Wellhead valve 31 is used to control vertical access to and fluid communication with bore 24 of tubing string 23. Blowout preventers 32 are normally installed between wellhead 21 and injector 25 to block fluid flow during emergency conditions.

Manifold 28 is connected to reel 27 by cleaning fluid supply line 34. Regulating valve or dump valve 35 is provided in supply line 34. Valve 35 can be temporarily opened to momentarily decrease the pressure of cleaning fluid supplied from manifold 28 to coil tubing 26.

As best shown in FIGS. 2A and B, well cleaning apparatus 40 consists of two downhole well tools—indexing or rotating tool 42 and cleaning tool 80. Indexing tool 42 can rotate cleaning tool 80 in response to cleaning fluid pressure changes. Indexing tool 42 has first mandrel means 45 with second mandrel means 60 slidably disposed therein. First or outer mandrel means 45 is essentially a long hollow cylinder with longitudinal flow passageway 46 extending therethrough. First mandrel means 45 includes end cap 47 with threads 41 and longitudinal flow passageway 46 therethrough. End cap 47 provides means for connecting one end of first mandrel means 45 to coil tubing 26 which in turn connects apparatus 40 to a source of cleaning fluid. End cap 48 is attached to the other end of first mandrel means 45. End cap 48 has opening 49 sized to allow second mandrel means 60 to be slidably and rotatably disposed therein. Portion **60*a* of second mandrel means 60 extends longitudinally from end cap 48**.

Second or inner mandrel means 60 is essentially a long, hollow cylinder. The outside diameter of second mandrel means 60 is substantially less than the inside diameter of first mandrel means 45. This difference in diameters creates annulus 50 when second mandrel means 60 is disposed within first mandrel means 45. This difference in diameters also allows second mandrel means 60 to rotate and slide longitudinally relative to first mandrel means 45. Longitudinal flow passageway 46 also extends through second mandrel means 60.

Means for rotating second mandrel means 60 relative to first mandrel means 45 in response to fluid pressure changes within longitudinal flow passageway 46 are disposed within annulus 50. The rotating means includes piston means 61, cylinders 51, 52, and 53, and biasing means or springs 54 and 55. Piston means 61 includes elastomeric seals 62 and 63 carried on the exterior of second mandrel means 60 to form a fluid barrier with the interior of first mandrel means 45 adjacent thereto. One side of piston means 61 (seal 62) is exposed to fluid pressure within longitudinal flow passageway 46. The other side of piston means 61 (seal 63) is exposed to fluid pressure within annulus 50. One or more ports 56 extend radially through first mandrel means 45 to equalize fluid pressure between annulus 50 and the exterior of first mandrel means 45. Thus, when fluid pressure in longitudinal flow passageway 46 exceeds fluid pressure in annulus 50, the difference in pressure creates a net force on piston means 61 to slide or extend longitudinally second mandrel means 60 further relative to first mandrel means 45.

First cylinder 51, second cylinder 52, and third cylinder 53 are disposed in annulus 50 between first mandrel means 45 and second mandrel means 60 to provide a portion of the means for translating longitudinal movement of second mandrel means 60 into rotation thereof. Second cylinder 52 is secured to the exterior of second mandrel means 60 by two or more set screws 64. Second cylinder 52 is located intermediate piston means 61 and portion 60*a* of second mandrel means 60. Set screws 64 provide means for securing second cylinder 52 to the exterior of second mandrel means 60 whereby they move in unison, both longitudinally and rotatably relative to first mandrel means 45.

First cylinder 51 and third cylinder 53 are disposed on opposite sides of second cylinder 52. Biasing means or spring 55 is carried between shoulder 65 and first cylinder 51 on the exterior of second mandrel means 60. Spring 55 urges first cylinder 51 to abut one end of second cylinder 52. Biasing means or spring 54 is carried between shoulder 66 on the interior of first mandrel means 45 and third cylinder 53. Biasing means 54 performs two functions. First, it urges third cylinder 53 to abut the other end of second cylinder 52. Second, spring 54 provides means for biasing second mandrel means 60 to retract from its further extended position. Spring 54 opposes the force of cleaning fluid pressure acting on piston means 61.

First set of matching ratchet teeth 67 is formed on the ends of first cylinder 51 and second cylinder 52 which abut each other. Teeth 67 are shaped to allow second cylinder 52 to rotate in only one direction relative to first cylinder 51. Second set of matching ratchet teeth 68 is formed on the ends of second cylinder 52 and third cylinder 53 which abut each other. Teeth 68 are shaped to allow third cylinder 53 to rotate in only the other direction relative to second cylinder 52.

As best shown in FIG. 2A, first pair of indexing pins 69 is securely engaged with first mandrel means 45 and slidably disposed in respective first control slots 70. First control slots 70 and associated first indexing pins 69 cooperate to allow limited longitudinal movement of first cylinder 51 relative to first mandrel means 45. This movement is shown in FIGS. 3–7. First control slots 70 are cut through first cylinder 51 such that the longitudinal axis of each control slot 70 is essentially parallel with the longitudinal axis of first mandrel means 45 and second mandrel means 60 when indexing tool 42 is assembled. Thus, first control slots 70 and first indexing pins 69 cooperate to prevent rotation of first cylinder 51 relative to first mandrel means 45.

Second pair of indexing pins 71 is securely engaged with first mandrel means 45 spaced longitudinally from first indexing pins 69. Second indexing pins 71 are slidably disposed in respective second control slots 72. Second control slots 72 are cut through third cylinder 53 such that the longitudinal axis of each control slot 72 is formed at an angle relative to the longitudinal axis of first mandrel means 45 and second mandrel means 60 when indexing tool 42 is assembled. Thus, second control slots 72 and second indexing pins 71 cooperate to cause partial rotation of third cylinder 53 relative to first mandrel means 45 when third cylinder 53 moves longitudinally relative thereto. The degree of rotation of cylinder 53 is directly proportional to the angle of control slots 72 relative to the axis of first mandrel means 45.

Matching threads 81 are machined on portion 60*a* of second mandrel means 60 and cleaning tool 80. Threads 81 provide means for attaching various cleaning tools to the portion of second mandrel means 60 extending from first mandrel means 45. Cleaning tool 80 is an oblong vessel having a relatively large fluid chamber 82. Cleaning fluid is supplied to chamber 82 from longitudinal flow passageway 46. A plurality of fluid jets 83 extends laterally through the exterior of cleaning tool 80. Jets 83 allow fluids from longitudinal flow passageway 46 to exit from chamber 82 and to clean the interior of well flow conductor 23 adjacent thereto.

Figure 9:
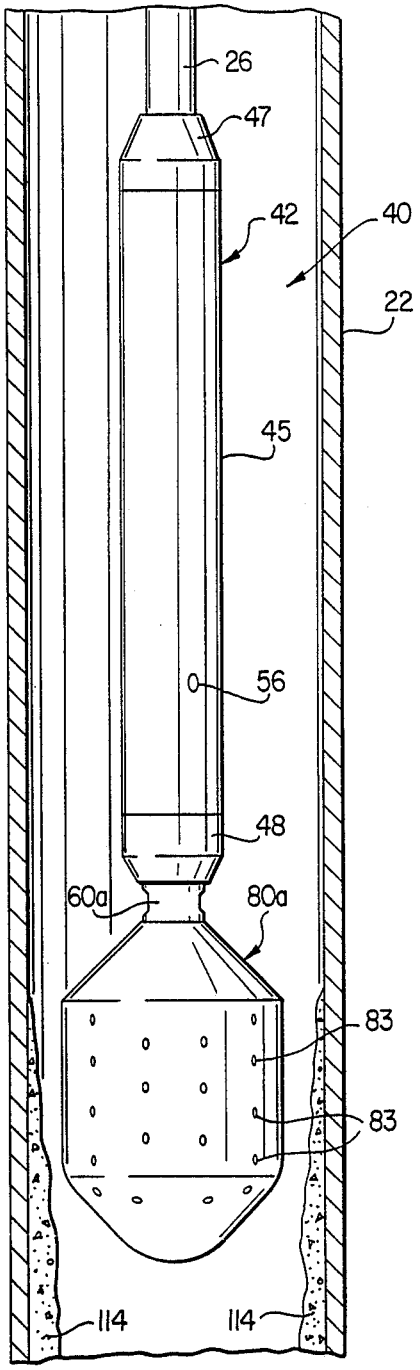
FIG. 9 is a schematic drawing, partially in elevation and partially in section, showing the indexing tool of FIG. 8 with a cleaning tool adapted for use in large diameter casing.

Various sizes and types of cleaning tools can be attached to indexing tool 42 corresponding to the sizes of the well flow conductor and the type of deposit to be cleaned. Cleaning tool 80*a* is an enlarged version of cleaning tool 80 for use in large diameter casing as best shown in FIG. 9. The outside diameter of cleaning tool 80*a* is selected to provide the desired standoff between fluid jets 83 and the interior of flow conductor 22 adjacent thereto. Cleaning tool 80*b* is essentially the same as cleaning tool 80*a* except that it is longer for greater vertical cleaning of a flow conductor.

For deposits such as sand bridge 100 which completely block tubing string 23, cleaning tool 90 is preferably used. The exterior of cleaning tool 90 is cylindrical, similar to cleaning tool 80. However, the lower end of cleaning tool 90 is truncated by beveled portion 91 and planar surface 92. Fluid jets 83 are drilled only in beveled portion 91. Therefore, well cleaning apparatus 40 with cleaning tool 90 attached can be lowered into tubing string 23 until planar surface 92 contacts sand bridge 100. Cleaning fluid from jets 83 strikes sand bridge 100 at an angle due to beveled portion 91. Planar surface 92 minimizes any friction forces which might restrict rotation of second mandrel means 60 due to contact of cleaning tool 90 with sand bridge 100. Thus, the present invention can be readily adapted for hydraulic drilling of downhole deposits.

Operating Sequence

Figure 3:
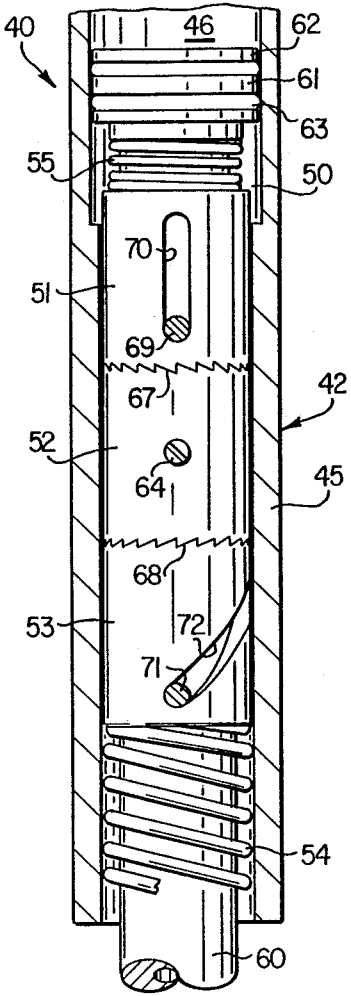
Figure 8:
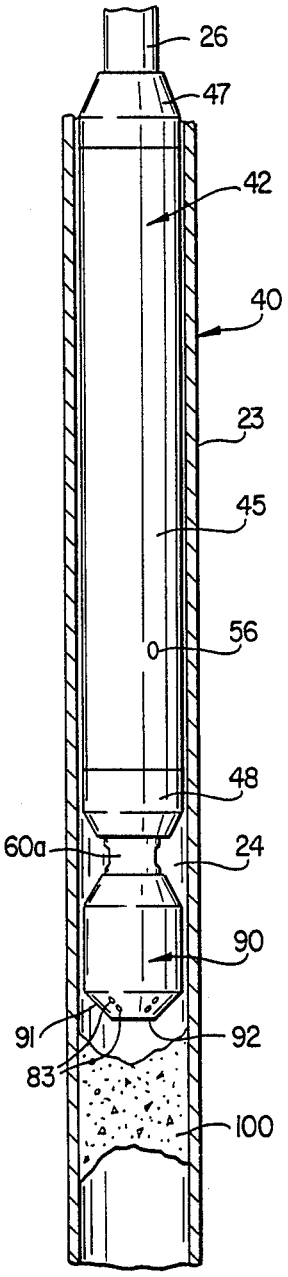
FIG. 8 is a schematic drawing, partially in elevation and partially in section, showing the indexing tool with a cleaning tool attached thereto for hydraulic drilling of a sand bridge in a tubing string.

FIGS. 3–7 show the sequence of events as cleaning fluid is supplied to apparatus 40 and second mandrel means 60 is rotated or indexed relative to first mandrel means 45. Indexing tool 42 is shown in FIG. 3 as it would appear with less fluid pressure applied to piston means 61 than required to overcome spring 54. This condition would exist when well cleaning apparatus 40 was being inserted into a flow conductor without cleaning fluid being pumped through coil tubing 26.

Figure 4:
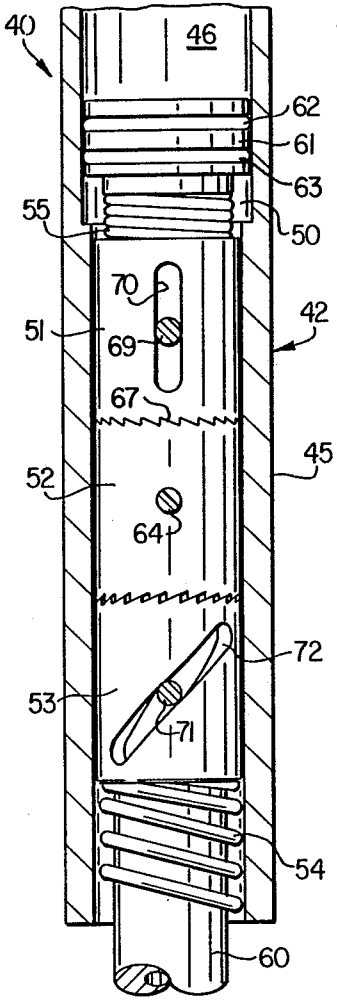

After positioning cleaning apparatus 40 at the desired location in the well flow conductor, cleaning fluid pressure is supplied to longitudinal flow passageway 46 from manifold 28 via coil tubing 26. When cleaning fluid pressure acting on piston means 61 exceeds the pressure of any fluid in annulus 50 and the force of spring 54, second mandrel means 60 and cylinders 51, 52, and 53 will move longitudinally relative to first mandrel means 45. Ratchet teeth 67 prevent relative rotational movement between first cylinder 51 and second cylinder 52. During this extension of second mandrel means 60, second indexing pin 71 and second control slot 72 cooperate to rotate or index third cylinder 53 one ratch tooth 68 relative to second cylinder 52. FIG. 4 shows the momentary gap between second cylinder 52 and third cylinder 53 created by this movement.

Figure 5:
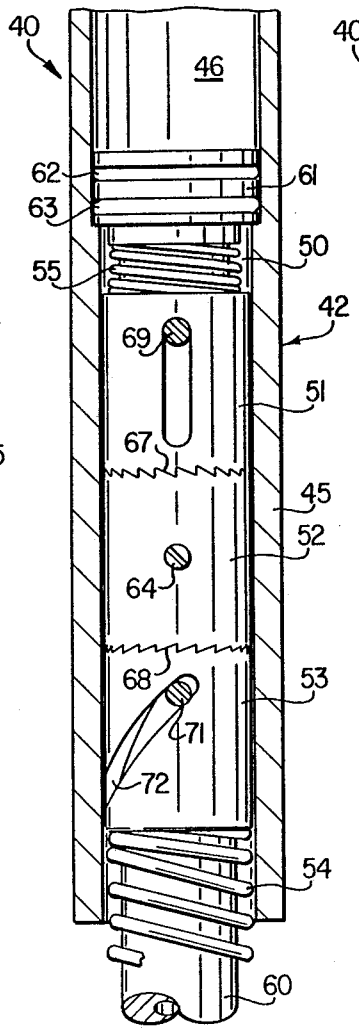

In FIG. 5, second mandrel means 60 is shown in its fully extended position relative to first mandrel means 45. Indexing tool 42 will remain in this position as long as cleaning fluid pressure in longitudinal flow passageway 46 applies more force to piston means 61 than spring 54 and any fluid pressure in annulus 50. FIG. 5 represents the normal position for indexing tool 42 when jet cleaning downhole deposits.

Figure 6:
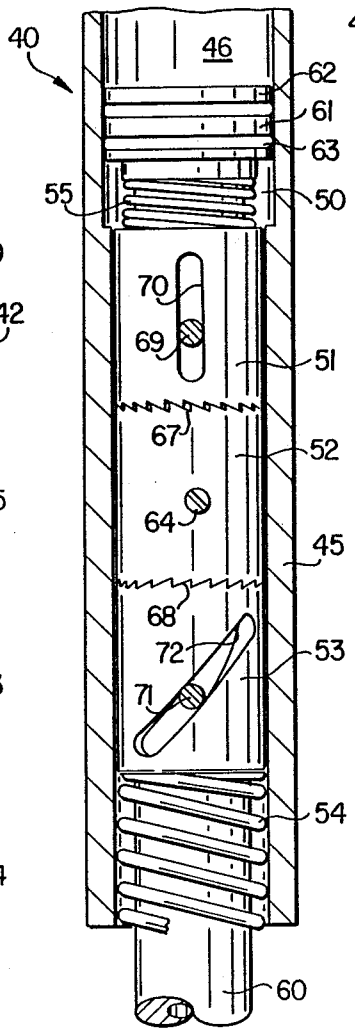

Inner mandrel means 60 can be rotated to position jets 83 of cleaning tool 80 adjacent to different poriions of the interior of the flow conductor being cleaned. By decreasing cleaning fluid pressure in longitudinal flow passageway 46 below a preselected value, spring 54 can retract or move second mandrel means 60 longitudinally upward. A temporary pressure decrease is possible by opening and closing valve 35 at the well surface. As second mandrel means 60 moves upward, indexing pin 71 and control slot 72 cause rotation of third cylinder 53. This rotation is transmitted to second cylinder 52 by ratchet teeth 68. Since second cylinder 52 is secured to second mandrel means 60 by set screws 64, second mandrel means 60 must also rotate during upward longitudinal movement. As shown in FIG. 6, ratchet teeth 67 allow second cylinder 52 to index or rotate one tooth 67 relative to first cylinder 51. This rotation causes the temporary gap between ratchet teeth 67 shown in FIG. 6.

When the upward movement is complete, second mandrel means 60 will have rotated one ratchet tooth. Note the relative position of set screw 64 in FIG. 3 as compared to FIG. 7. Thus, a series of cleaning fluid pressure changes can rotate second mandrel means 60 and cleaning tool 80 through three hundred and sixty degrees.

Alternative Embodiments

Pairs of indexing pins 69 and 71 with respective control slots 70 and 72 are shown in FIG. 2A. However, indexing tool 42 could function with only one indexing pin 69 and one indexing pin 71 if desired. For larger sizes of indexing tool, more than two indexing pins 69 and two indexing pins 71 may be required. Also, first control slots 70 could be cut at an angle relative to the longitudinal axis of first mandrel means 45 and second control slots 72 cut parallel thereto.

As best shown in FIG. 11, third cylinder 53 can have multiple second control slots **72*a*, 72*b*, and 72*c* cut therein with each slot formed at a different angle. By properly selecting ratchet teeth 67 and 68 and the angle for each control slot 72*a*, 72*b*, and 72*c*, the degree of rotation or indexing of second mandrel means 60 can be preselected by inserting second indexing pins 71 into the desired second control slot 72. For example, second control slot 72*a* can be formed at a fifteen degree angle to correspond with indexing one ratchet tooth 67. Second control slot 72*b* can be formed at a thirty degree angle to correspond with indexing two ratchet teeth 67. Second control slot 72*c* can be formed at a forty five degree angle to correspond with indexing three ratchet teeth 67**.

Figure 12:
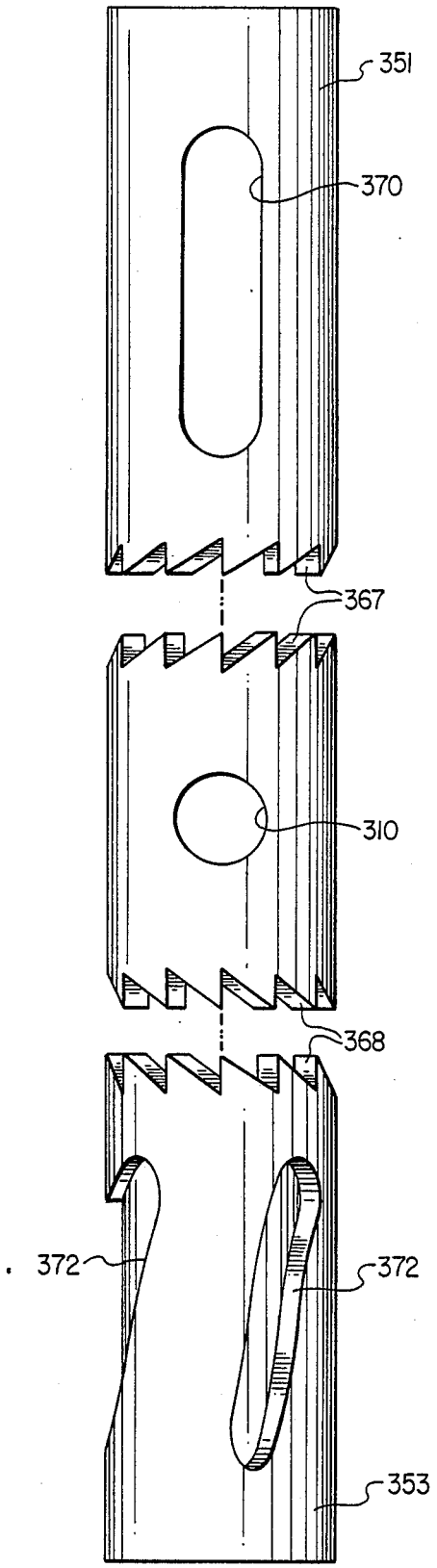
FIG. 12 is an enlarged drawing in elevation showing an alternative design for the first, second, and third cylinders used with the indexing tool of FIGS. 2A and B.

For some downhole well conditions, cylinders 51, 52, and 53 may not satisfacorily rotate second mandrel means 60 relative to first mandrel means 45. As shown in FIGS. 3–7, rotation of second mandrel means 60 occurs only when spring 54 lifts or returns piston means 61 to its upper position after fluid pressure has been reduced. See FIG. 6. The hydrostatic pressure of fluids in coil tubing 26 or debris accumulating around piston means 61 may hinder spring 54 from moving second mandrel means 60. Cylinders 351, 352, and 353 as shown in FIG. 12 may be substituted for previously described cylinders 51, 52, and 53. The principal difference between these cylinders is the configuration of matching ratchet teeth 367 as compared to teeth 67 and matching ratchet teeth 368 as compared to teeth 68. Ratchet teeth 368 cooperate with slots 372 to cause rotation as fluid pressure moves second mandrel means 60 to its fully extended position. Spring 54 only has to move second mandrel means 60 longitudinally in the opposite direction. Therefore, cylinders 351, 352, and 353 with ratchet teeth 367 and 368 eliminate the requirement for spring 54 to also rotate second mandrel means 60 as previously shown in FIGS. 6 and 7.

First cylinder 351, second cylinder 352, and third cylinder 353 can be placed in annulus 50 between first mandrel means 45 and second mandrel means 60 to provide a portion of the means for translating longitudinal movement of second mandrel means 60 into rotation thereof. Second cylinder 352 can be secured to the exterior of second mandrel means 60 by inserting two or more set screws 64 into opening 310. Second cylinder 352 should be located intermediate piston means 61 and portion **60*a* of second mandrel means 60. Set screws 64 provide means for securing second cylinder 352 to the exterior of second mandrel means 60 whereby they move in unison, both longitudinally and rotatably relative to first mandrel means 45. Cylinder 352 can also be satisfactorily secured to second mandrel means 60 by other means such as a key and slot, tongue and groove, or similar construction techniques. First cylinder 351 and third cylinder 353 are then installed on opposite sides of second cylinder 352. Second mandrel means 60 will move longitudinally and rotate in response to fluid pressure changes in a similar manner as previously described when using cylinders 51, 52, and 53**.

The previous description is illustrative of only some embodiments of the present invention. Those skilled in the art will readily see other variations and modifications without departing from the scope of the invention as defined in the claims.

What is claimed is:

1. Apparatus for cleaning flow conductors comprising:

a. first mandrel means and second mandrel means with a longitudinal flow passageway extending through each;

b. means for connecting one end of the first mandrel means to a source of cleaning fluid;

c. the second mandrel means slidably disposed within the first mandrel means and a portion of the second mandrel means extending from the other end of the first mandrel means;

d. means for rotating the second mandrel means relative to the first mandrel means in response to fluid pressure changes within the longitudinal flow passageway;

e. means for attaching a cleaning tool to the portion of the second mandrel means extending from the first mandrel means;

f. piston means attached to the second mandrel means;

g. one side of the piston means exposed to fluid pressure within the longitudinal flow passageway and the other side of the piston means exposed to fluid pressure exterior to the first mandrel means whereby fluid pressure on the one side of the piston means will move the second mandrel means longitudinally to a further extended position relative to first mandrel means;

h. means for biasing the second mandrel means to retract from its further extended position; and i. means for translating longitudinal movement of the second mandrel means into rotational movement.

2. Apparatus as defined in claim 1 further comprising a plurality of fluid jets in the cleaning tool whereby fluid in the longitudinal flow passageway can exit via the fluid jets to clean the interior of the flow conductor.

3. Apparatus as defined in claim 2 further comprising the plurality of fluid jets near the lower end of the cleaning tool whereby rotation of the second mandrel means produces hydraulic drilling action with the cleaning tool.

4. Apparatus as defined in claim 2 wherein the cleaning tool further comprises:

a. an oblong vessel with a fluid chamber therein; and b. the jets extending laterally through the vessel to allow cleaning fluid to be projected against the interior of the flow conductor adjacent thereto.

5. Apparatus as defined in claim 1 further comprising:

a. small diameter tubing providing the source of cleaning fluid; and b. the first mandrel means sized to be disposed within a downhole well tubular.

6. Apparatus as defined in claim 1 wherein the outside diameter of the cleaning tool is substantially larger than the outside diameter of the first mandrel means.

7. Apparatus for cleaning flow conductors comprising:

a. first mandrel means and second mandrel means with a longitudinal flow passageway extending through each;

b. means for connecting one end of the first mandrel means to a source of cleaning fluid;

c. the second mandrel means slidably disposed within the first mandrel means and a portion of the second mandrel means extending from the other end of the first mandrel means;

d. means for rotating the second mandrel means relative to the first mandrel means in response to fluid pressure changes within the longitudinal flow passageway;

e. means for attaching a cleaning tool to the portion of the second mandrel means extending from the first mandrel means;

f. the means for rotating the second mandrel means comprising a piston means attached to the second mandrel means;

g. one side of the piston means exposed to fluid pressure within the longitudinal flow passageway and the other side of the piston means exposed to fluid pressure exterior to the first mandrel means whereby fluid pressure on the one side of the piston means will move the second mandrel means longitudinally to a further extended position relative to first mandrel means;

h. means for biasing the second mandrel means to retract from its further extended position;

i. means for translating longitudinal movement of the second mandrel means into rotational movement comprising first, second and third cylinders disposed between the interior of the first mandrel means and the exterior of the second mandrel means;

j. means for securing the second cylinder to the exterior of the second mandrel means whereby the second cylinder and second mandrel means move in unison;

k. a first set of ratchet teeth on the ends of the first cylinder and the second cylinder which abut each other to allow the second cylinder to rotate only in one direction relative to the first cylinder;

l. a second set of ratchet teeth on the ends of the third cylinder and the second cylinder which abut each other to allow the third cylinder to rotate only in the opposite direction relative to the second cylinder;

m. a first indexing pin between the first mandrel means and a control slot in the first cylinder to allow limited longitudinal movement of the first cylinder relative to the first mandrel means;

n. a second indexing pin between the first mandrel means and a control slot in the third cylinder to allow limited longitudinal movement of the third cylinder relative to the first mandrel means; and o. one control slot formed at an angle whereby longitudinal movement of its respective cylinder with respect to its indexing pin results in partial rotation of the cylinder.

8. Apparatus as defined in claim 7 further comprising:

a. the indexing pins and control slots allowing limited longitudinal movement of their respective cylinder relative to the second cylinder; and b. biasing means to urge both sets of ratchet teeth into firm engagement.

9. Apparatus as defined in claim 7 wherein the ratchet teeth allow rotation of the second mandrel means only as it moves to its further extended position.

10. Apparatus as defined in claim 7 wherein the ratchet teeth prevent rotation of the second mandrel means while being retracted by the biasing means.

11. Apparatus as defined in claim 7 further comprising one cylinder having multiple control slots formed at various angles relative to the longitudinal flow passageway whereby the amount of rotation can be preselected by inserting the indexing pin into different control slots.

12. The method of cleaning the interior of a well flow conductor using coil tubing, an indexing tool and a cleaning tool with fluid jets comprising:

a. inserting into the well flow conductor the coil tubing with the indexing tool and the cleaning tool attached thereto;

b. moving the coil tubing longitudinally through the well flow conductor until the cleaning tool is positioned adjacent to the interior portion of the well flow conductor to be cleaned;

c. supplying cleaning fluid pressure from the well surface via the coil tubing to the indexing tool and the cleaning tool;

d. moving the cleaning tool longitudinally by movement of the coil tubing whereby clean fluid exiting from the fluid jets in the cleaning tool will clean the interior of the well flow conductor adjacent thereto;

e. momentarily decreasing the cleaning fluid pressure supplied to the indexing tool to rotate the cleaning tool attached thereto; and f. repeating steps d and e until the interior of the well flow conductor is satisfactorily cleaned.

13. The method of claim 12 further comprising the step of installing a cleaning tool with the desired amount of standoff between the fluid jets and the interior of the well flow conductor adjacent thereto.

14. The method of claim 12 further comprising the step of selecting the amount of rotation by the cleaning tool in response to each pressure change.

* * * * *